United States Patent [19]

Yamaguchi

[11] Patent Number: 4,667,422

[45] Date of Patent: May 26, 1987

[54] GOLF SHOE SPIKE

[75] Inventor: Mitsuhiro Yamaguchi, Hyogo, Japan

[73] Assignee: Morito Co., Ltd., Osaka, Japan;

[21] Appl. No.: 851,332

[22] Filed: Apr. 14, 1986

[30] Foreign Application Priority Data

Apr. 19, 1985 [JP] Japan ..... 60-85127

[51] Int. Cl.[4] ..... A43C 13/04; A43C 15/00; A43B 5/00

[52] U.S. Cl. ..... 36/67 A; 36/127; 36/134

[58] Field of Search ..... 36/67 R, 67 A, 67 B, 36/67 D, 127, 128, 134, DIG. 2

[56] References Cited

U.S. PATENT DOCUMENTS

| | | | |
|---|---|---|---|
| 2,419,387 | 4/1947 | Bierer | 36/DIG. 2 |
| 3,522,669 | 8/1970 | Simons | 36/67 A |
| 3,602,889 | 10/1971 | Calvin et al. | 36/67 R |
| 3,626,611 | 12/1971 | Bernier et al. | 36/67 R |
| 3,760,514 | 9/1973 | Egtvedt | 36/67 R |
| 3,828,364 | 8/1974 | Aoyama | 36/67 B |
| 4,445,288 | 5/1984 | Fror | 36/134 |

FOREIGN PATENT DOCUMENTS

| | | | |
|---|---|---|---|
| 3233900 | 3/1984 | Fed. Rep. of Germany | 36/67 R |
| 58-15074 | 1/1983 | Japan | 36/134 |
| 58-15075 | 1/1983 | Japan | 36/134 |

*Primary Examiner*—James Kee Chi

*Attorney, Agent, or Firm*—Trexler, Bushnell, Giangiorgi & Blackstone, Ltd.

[57] ABSTRACT

A golf shoe spike (S) comprising a ceramic pin (P) and an aluminum or aluminum alloy washer (b). The pin comprises a generally conical shank portion (11) and a seating portion (12) contiguous thereto and having an increased diameter. The washer (b) comprises a base portion (1) having an accomodating recess (3) on its top side and a central hole (5) through its bottom (6) and a flange portion (2) around said base portion (1). The pin (P) is inserted into the central hole (5) of the washer (b) and the outer peripheral wall portion (4) defining the accomodating recess (3) is caulked or drawn inwards to secure the seating portion (12) of the pin (P) tightly against the bottom portion (6) of the recess (3).

7 Claims, 9 Drawing Figures

GOLF SHOE SPIKE

FIELD OF THE INVENTION AND RELATED ART STATEMENT

The present invention relates to a golf shoe spike having a ceramic pin, which is abrasion-resistant and durable.

There is known a light-weight, durable spike for golf shoes comprising a ceramic pin having a generally conical shank portion and a seating portion embedded in a rigid synthetic resin seat plate.

However, when the above spike is embedded in a golf shoe sole, the forces applied to the pin in the field use of the shoe cause a gap between the pin and the seat plate or a breakage of the seat plate so that the inherent abrasion resistance and durability of, the ceramic pin cannot be fully exploited.

To overcome the above disadvantage, an attempt has been made to form the seat plate from a synthetic resin containing carbon fiber but such a spike has the disadvantage of high production cost.

OBJECT AND SUMMARY OF THE INVENTION

It is an object of the present invention to provide a light-weight, durable golf shoe spike which makes the most of the inherent abrasion resistance and durability of the ceramic pin.

The present invention, which accomplish the above object, is a golf shoe spike comprising a mounting washer of aluminum or aluminum alloy including of a base portion having an accommodating recess on its top side and a central hole through its bottom, and a ceramic pin including a seating portion adapted to be set in said accommodating recess and a shank portion having a generally conical configuration which is contiguous to said seating portion and adapted to be inserted through said central hole.

In the golf shoe spike according to the present invention, the seating portion of a ceramic pin is attached to the base portion of an aluminum or aluminum alloy mounting washer, with the result that the risk of breakage of the mounting washer during field use of the shoe is minimized and the inherent abrasion resistance and durability of the ceramic pin can be fully exploited.

Furthermore, the golf shoe spike according to the present invention employs a mounting washer made of aluminum or aluminum alloy and this mounting washer is comparatively soft and good in workability, so that the seating portion of the pin can be easily affixed to the base portion of the mounting washer.

Preferably, the outer peripheral wall defining the accommodating recess of the mounting washer is caulked or drawn inwards to affix the seating portion of the pin securely to the base of the mounting washer. In this arrangement, as the outer peripheral wall to be caulked is located on the upper side of the mounting washer, the shank portion of the pin is not injured during caulking or drawing operations.

Preferably, an integrating means is provided between the seat portion of the mounting washer and a shoe sole to which the spike is to be attached. This integrating means may be any of at least one through hole, at least one projection, and at least one nick or cut-off portion, or a combination of them. In this arrangement, the spike is firmly attached to the shoe sole by said integrating means to provide an integral unit so that the pin is prevented from falling down or rotating. Furthermore, the golf shoe spike according to the present invention is free from the disadvantage of a gap created between the mounting washer and the shoe sole by forces acting on the pin during use of the golf shoe or upon bending of the shoe sole. Consequently, the present invention permits production of a golf shoe having an extended life of spikes and hence, a long service life.

Other objects and advantages of the present invention will become apparent from the following detailed description of the invention.

BRIEF DESCRIPTION OF THE DRAWINGS

A few preferred embodiments of the invention will now be described with reference to the accompanying drawings, in which.

DETAILED DESCRIPTION OF PREFERRED EMBODIMENTS

Figure 1:
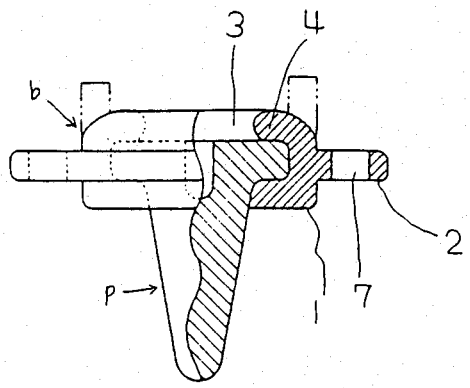
FIG. 1 is a partially exploded front elevation view showing a golf shoe spike according to the present invention.
Figure 3:
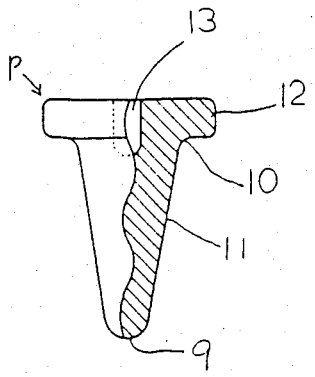
FIG. 3 is a partially exploded front elevation view showing a pin according to the present invention.
Figure 2:
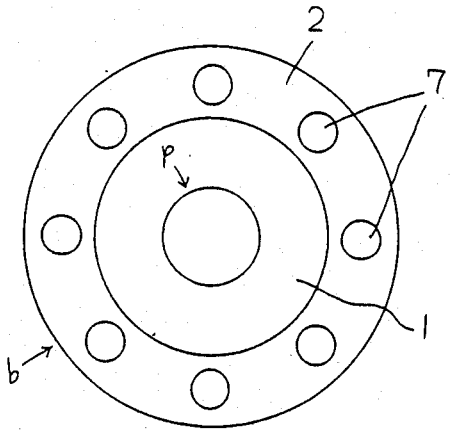
FIG. 2 is a bottom view of the same golf shoe spike according to the present invention.

Referring, first, to FIGS. 1 and 2, the golf shoe spike according to the present invention comprises a pin P of ceramic material and a mounting washer b of aluminum or aluminum alloy.

The ceramic pin P comprises a shank portion 11 having a generally conical shape and a seating portion 12 contiguous to the shank portion.

The ceramic material may be any of alumina, zirconia, thermet and other materials. The preferable material is zirconium oxide containing 3 to 20 mole percent of yttrium oxide.

The shank portion 11 has a generally conical shape with a rounded apex 9 and a progressively increasing sectional area toward a base portion 10 which is contiguous to a seat portion 12 which is larger in diameter. The upper side of the seat portion 12 has a die recess 13 in its center.

Figure 4:
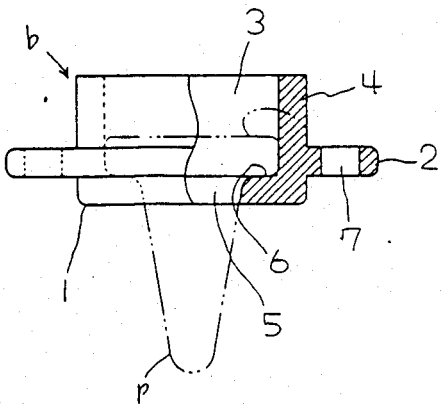
FIG. 4 is a partially exploded front elevation view showing a mounting washer according to the present invention.

The mounting washer b is made of aluminum or aluminum alloy and, as shown in FIG. 4, comprises a base portion 1 adapted to secure the seating portion 12 of pin P and a flange portion 2 formed around the base portion 1.

Before formation of the spike, the base portion 1 of the mounting washer b presents a generally dish-like configuration, comprising a bottom portion 6 and an outer peripheral wall portion 4. The upper side of the dish-shaped base portion has an open accommodating recess 3 and the bottom portion 6 thereof is provided with a central hole through which the shank portion 11 of the pin can be inserted. The flange portion 2 of the mounting washer b extends horizontally and radially at a level slightly above the bottom portion 6 of the mounting washer b. This flange portion 2 is provided with a plurality of through holes (8 in the drawing).

To assemble the pin P with the mounting washer to provide a spike S, the seating portion 12 of ceramic pin P is set in the accommodating recess 3 of the mounting washer b, with the shank portion 11 of the pin P inserted into the central hole 5 of the mounting washer b. Then, the outer peripheral wall portion 4 defining the accommodating recess 3 of the mounting washer b is caulked or drawn inwards to secure the seating portion 12 of the pin P tightly against the bottom portion 6 of the recess 3 and thereby fix the pin P securely to the base portion 1 of the mounting washer b.

Figure 5:
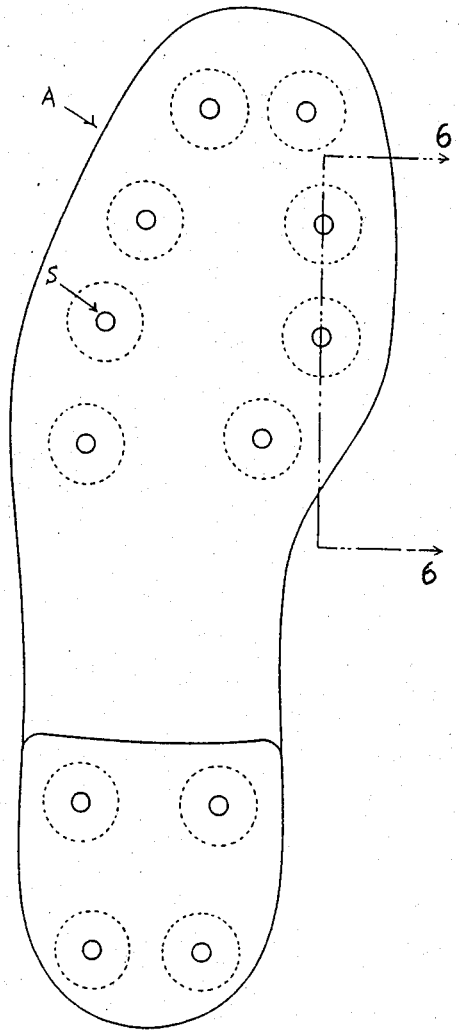
FIG. 5 is a schematic view illustrating a golf shoe equipped with spikes according to the present invention.
Figure 6:
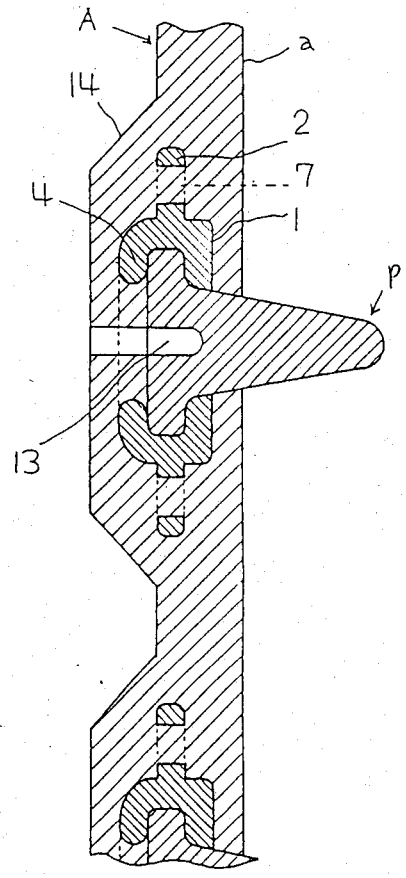
FIG. 6 is a sectional view, on exaggerated scale and partially omitted, taken along the line 6—6 of FIG. 5.

To assemble the thus-prepared spikes S with a shoe sole A, the die hole 13 of the spike S is mated with one of projections preformed on the shoe sole A. A required number of spikes S are thus set on the shoe sole A. Then, a powerful synthetic resin composition is injected to make a golf shoe sole as illustrated in FIGS. 5 and 6.

The shoe sole A may be made of a synthetic resin such as a rigid synthetic polymer, e.g. nylon, polyurethane, etc., or a flexible synthetic resin, e.g. polyurethane foam.

As the flange portion 2 of the mounting washer is provided with a plurality of through holes 7, the synthetic resin composition finds its way into the through holes 7 and, upon cure, prevents rotation of the mounting washer relative to the shoe sole.

When a transparent material is used as said synthetic resin composition and a trademark or other pattern is engraved on the mounting washer, the transparent resin composition functions as a protective coating for the trademark or other pattern so that the latter is not obliterated by abrasion.

Figure 8:
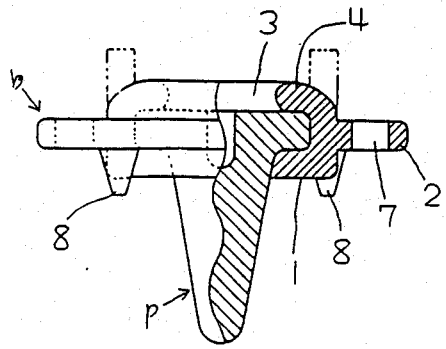
FIG. 8 is a front elevation view, in partial section, showing still another golf shoe spike according to the present invention.
Figure 9:
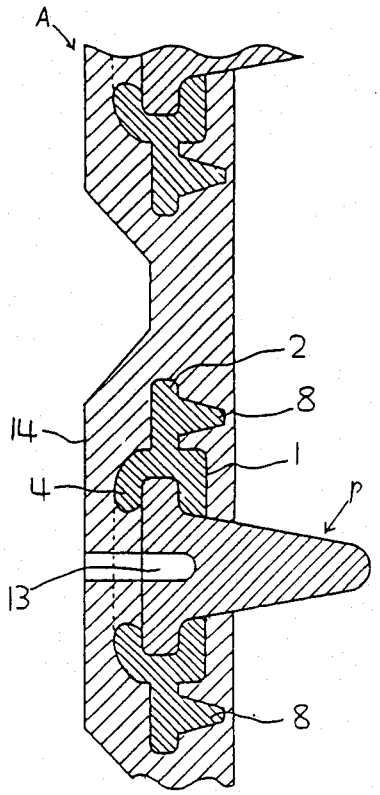
FIG. 9 is a schematic view illustrating a golf shoe equipped with spikes according to the embodiment shown in FIG. 8.

While, in the above embodiment, the integral joint between the shoe sole A and the spikes S was achieved with the aid of a plurality of through holes 7 of the mounting washer b, a similar effect can be realized by other techniques. For example, as illustrated in FIGS. 8 and 9, the mounting washer b may be provided with one or more truncated-conical projections. In the embodiment shown in FIG. 8, these projections are used in conjunction with the aforementioned through holes. Aside from the above, the flange portion 2 may be provided with one or more nicks around its periphery. These three devices of through holes 7, nicks and projections 8 may all be used together in a suitable combination.

Figure 7:
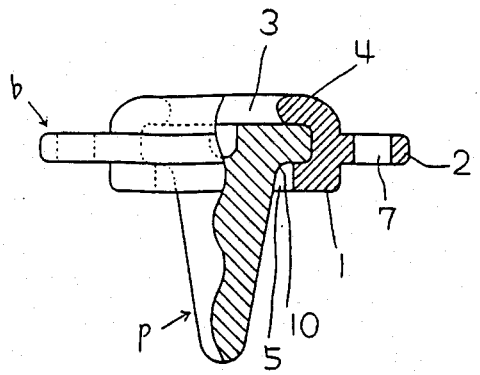
FIG. 7 is a front elevation view, in partial section, of another golf shoe spike according to the present invention.

In the foregoing embodiments, the central hole 5 of the mounting washer b has approximately the same diameter and shape as the base portion 10 of the pin P so as to leave no clearance between the hole 5 and the base portion 10 as is seen from FIG. 1 but the diameter of the hole 5 may be made larger so that the base portion 10 of the pin P will not contact the wall defining the hole 5 as is seen from FIG. 7.

What is claimed is:

1. A golf shoe spike comprising: a pin of ceramic material including a shank portion having a generally conical configuration and a seating portion contiguous to the shank portion, and a mounting washer of aluminum or aluminum alloy including a base portion having an accommodating recess on its top side adapted to accommodate the seating portion of the pin and a central hole through its center adapted to receive the shank portion of the pin, and a mounting flange portion around said base portion, said accomodating recess being defined by an outer peripheral wall projecting outwardly of said base portion, said outer peripheral wall being deformed inwardly to thereby firmly engage the seating portion of the pin between the inwardly deformed wall portion and the base portion of the mounting washer, said flange portion of the mounting washer being provided with integral means for affixing the flange portion of the mounting washer to a shoe sole.

2. A golf shoe spike according to claim 1 wherein means for affixing the seat portion of the mounting washer to a shoe hole has been provided.

3. A golf shoe spike according to claim 2 wherein said means is any of at least one through hole, at least one projection and at least one nick, or a combination of them.

4. A golf shoe spike according to claim 1 wherein said pin is made of zirconium oxide containing 3 to 20 percent by mole of yttrium oxide.

5. A golf shoe spike according to claim 1 in combination with a shoe sole which is made of resin composition.

6. A golf shoe spike according to claim 5 wherein a trademark or other pattern is engraved on the mounting washer and a transparent material is used as said resin composition.

7. A golf shoe spike comprising: a pin made of zirconium oxide containing 3 to 20 mole percent of yttrium oxide substantially free of aluminum or aluminum oxide including a shank portion having a generally conical configuration and a seating portion contiguous to the shank portion, and a mounting washer of aluminum or aluminum alloy including a base portion having an accommodating recess on its top side adapted to accommodate the seating portion of the pin and a central hole through its center adapted to receive the shank portion of the pin, and a flange portion around said base portion, said accommodating recess being defined by an outer peripheral wall projecting outwardly of said base portion, said outer peripheral wall being deformed inwardly to thereby affix the seating portion of the pin between the inwardly deformed wall portion and the base portion of the mounting washer, said flange portion of the mounting washer being provided with integral means for affixing the flange portion of the mounting washer to a shoe sole.

* * * * *